US009620906B1

(12) United States Patent
Briant et al.

(10) Patent No.: US 9,620,906 B1
(45) Date of Patent: Apr. 11, 2017

(54) EMI SHIELDING FOR PLUGGABLE MODULES

(71) Applicant: TYCO ELECTRONICS CORPORATION, Berwyn, PA (US)

(72) Inventors: Eric David Briant, Dillsburg, PA (US); James Charles Shiffler, Hershey, PA (US); Charles Jameson Valentine, Lancaster, PA (US); Richard James Long, Columbia, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/929,883

(22) Filed: Nov. 2, 2015

(51) Int. Cl.
*H01R 13/648* (2006.01)
*H01R 13/6581* (2011.01)

(52) U.S. Cl.
CPC ..... *H01R 13/6581* (2013.01)

(58) Field of Classification Search
CPC ..... H01R 13/6658; H01R 23/7068; H01R 13/65802; H01R 13/658; H01R 23/7073; H01K 9/0058; H01L 23/4093; H01L 23/4006; G02B 6/4292; F21V 29/004
USPC ..... 439/76.1, 59, 60, 607.01, 607.2, 607.21, 439/607.55, 660, 939, 485, 487; 361/704; 385/88, 92
See application file for complete search history.

(56) References Cited

U.S. PATENT DOCUMENTS 6,478,622 B1 * 11/2002 Hwang ..... H01R 13/65802 385/92
6,752,663 B2 * 6/2004 Bright ..... G02B 6/4201 439/607.25
6,893,293 B2 5/2005 Ice et al.
7,150,653 B1 * 12/2006 Mason ..... H01R 13/65802 385/92
7,764,504 B2 * 7/2010 Phillips ..... G02B 6/4246 165/80.2
7,766,679 B2 * 8/2010 Endou ..... G02B 6/4201 439/160
8,182,291 B2 * 5/2012 Tsou ..... H01R 23/6873 439/607.55
8,834,205 B2 * 9/2014 Fogg ..... H01R 13/6587 439/607.21
8,870,595 B2 * 10/2014 Schmitt ..... H01R 13/6587 439/607.25
8,890,004 B2 * 11/2014 Wickes ..... H01R 13/6583 174/354
9,122,030 B2 * 9/2015 Xie ..... G02B 6/4277
(Continued)

*Primary Examiner* — Thanh Tam Le

(57) ABSTRACT

A connector assembly includes a cage member having walls defining a module cavity receiving a pluggable module. The walls extend rearward from a front end to a rear end and surround a communication connector at or near the rear end. An EMI skirt is provided at or near the mating interface between the pluggable module and the communication connector. The EMI skirt includes plural spring beams configured to surround a mating perimeter of the pluggable module forward of a mating end of the pluggable module configured to be mated with the communication connector. The spring beams are deflectable and are elastically deformed against the mating perimeter when the pluggable module is mated with the communication connector. The spring beams have mating interfaces configured to engage and electrically connect to the pluggable module.

20 Claims, 5 Drawing Sheets

(56) References Cited

U.S. PATENT DOCUMENTS

| | | | | |
|---|---|---|---|---|
| 9,325,100 | B2 * | 4/2016 | Hirschy | H01R 13/6595 |
| 2013/0034993 | A1 * | 2/2013 | Szczesny | H01R 13/6587<br>439/607.17 |
| 2014/0153192 | A1 * | 6/2014 | Neer | H05K 9/0058<br>361/704 |
| 2015/0029667 | A1 * | 1/2015 | Szczesny | F28D 15/0275<br>361/700 |

* cited by examiner

EMI SHIELDING FOR PLUGGABLE MODULES

BACKGROUND OF THE INVENTION

The subject matter described herein relates to EMI shielding for pluggable modules.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a cage member that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection.

One challenge often encountered in the design of the pluggable module and receptacle assembly is the containment and management of electromagnetic interference (EMI), which negatively affects module/system electrical performance. Typically, an EMI gasket is provided at the opening to contain EMI leakage in the system and/or to block EMI radiation from entering the system. Such EMI gaskets block substantially all of the space in the opening around the pluggable module with metal beams or fingers. However, such EMI gaskets have the negative effect of blocking airflow through the opening, which could be used to cool the pluggable module and other components of the system. Some known communication systems are designed to provide a large airflow channel at the opening to encourage airflow into or out of the cage member. The EMI gasket must be removed to provide the airflow channel.

Accordingly, there is a need for EMI shielding of pluggable modules for use in communication systems that allow significant airflow and heat transfer through the cage member.

BRIEF DESCRIPTION OF THE INVENTION

In an embodiment, a connector assembly is provided including a cage member having a plurality of walls defining a module cavity configured to receive a pluggable module therein through a front end of the cage member. The walls are manufactured from a metal material and providing electrical shielding for the module cavity. The walls extend rearward from the front end to a rear end of the cage member where the walls are configured to surround a communication connector at or near the rear end. The module cavity has a pluggable module segment at or near the front end receiving the pluggable module and a communication connector segment at or near the rear end receiving the communication connector. An EMI skirt is provided at or near an intersection of the pluggable module segment and the communication connector segment of the module cavity. The EMI skirt includes plural spring beams configured to surround a mating perimeter of the pluggable module forward of a mating end of the pluggable module configured to be mated with the communication connector. The spring beams are deflectable and are elastically deformed against the mating perimeter when the pluggable module is mated with the communication connector. The spring beams have mating interfaces configured to engage and electrically connect to the pluggable module.

In a further embodiment, a communication system is provided including a pluggable module having a pluggable body extending between a mating end and a cable end. The pluggable body has a first end and an opposite second end with sides extending therebetween along a length of the pluggable body. The pluggable body has a mating perimeter defined by the ends and sides along a portion of the length forward of the mating end. The pluggable module has an internal circuit board held in the pluggable body. The communication system includes a connector assembly including a communication connector and a cage member. The cage member has a plurality of walls defining a module cavity. The walls are manufactured from a metal material and provide electrical shielding for the module cavity. The module cavity has a pluggable module segment at or near a front end of the cage member receiving the pluggable module. The module cavity has a communication connector segment at or near a rear end of the cage member receiving the communication connector. The connector assembly has an EMI skirt at or near an intersection of the pluggable module segment and the communication connector segment of the module cavity. The EMI skirt includes plural spring beams surrounding the mating perimeter of the pluggable module. The spring beams are deflectable and are elastically deformed against the mating perimeter when the pluggable module is mated with the communication connector such that the internal circuit board is communicatively coupled to the communication connector. The spring beams have mating interfaces configured to engage and electrically connect to the corresponding ends and sides of the pluggable module at the mating perimeter.

DETAILED DESCRIPTION OF THE INVENTION

Embodiments set forth herein include electromagnetic interference (EMI) shielding for communication systems, such as between cage members and pluggable modules. The pluggable module provides significant thermal transfer for the components thereof. Various embodiments of the communication system provide enhanced airflow through the cage member for heat dissipation of the pluggable module and an EMI shielding design that works with the enhanced airflow cage member. For example, exemplary embodiments set forth herein provide fins with the pluggable module that enhance transfer heat transfer and an air channel through the cage member that allows air to flow along the fins to cool the pluggable modules. In various embodiments, the EMI shielding is provided at the mating end of the pluggable module as opposed to at the bezel interface, as with conventional communication systems, which would block airflow through the cage member.

Figure 1:
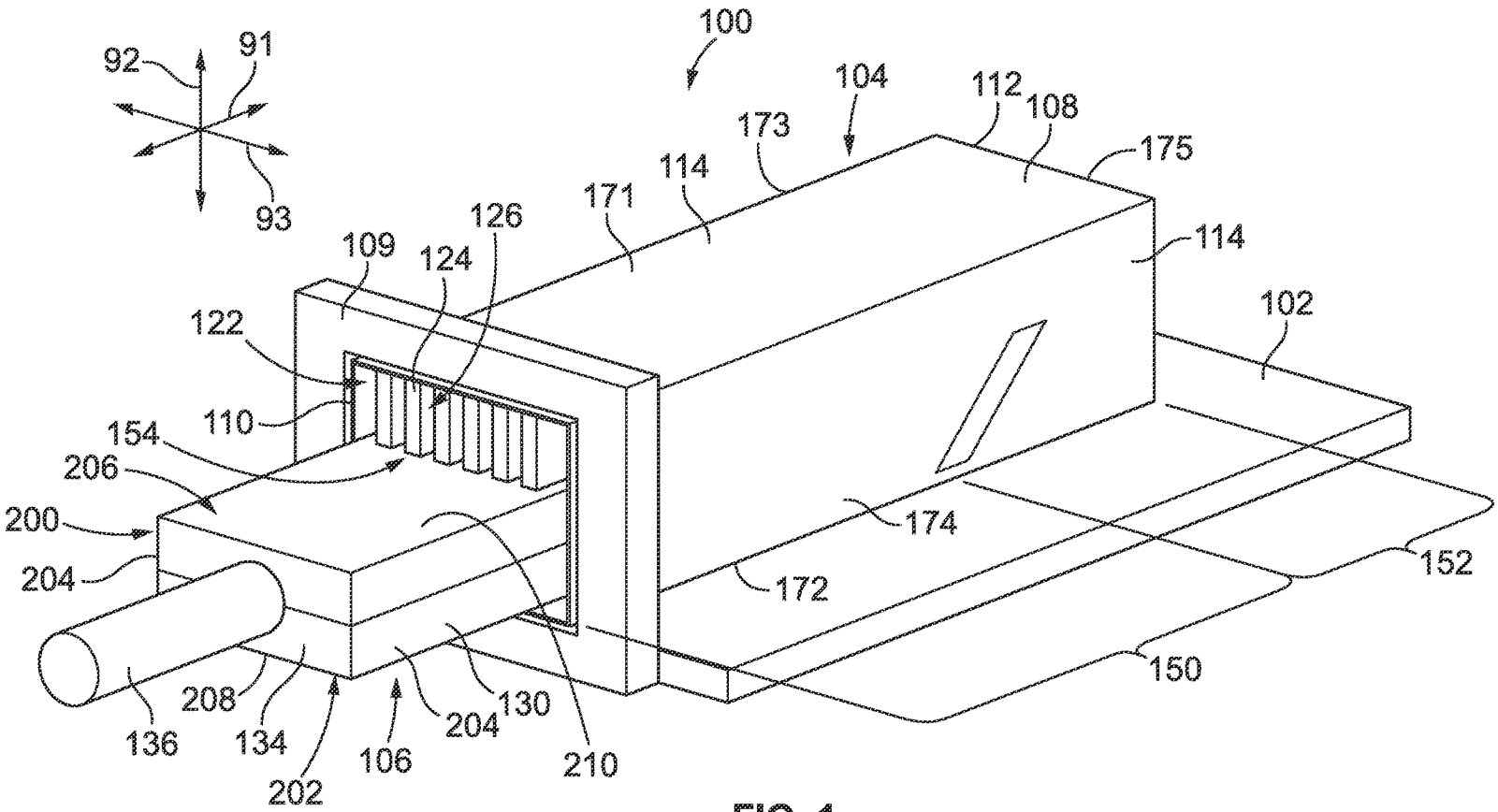
FIG. 1 is a front perspective view of a communication system in accordance with an embodiment.
Figure 2:
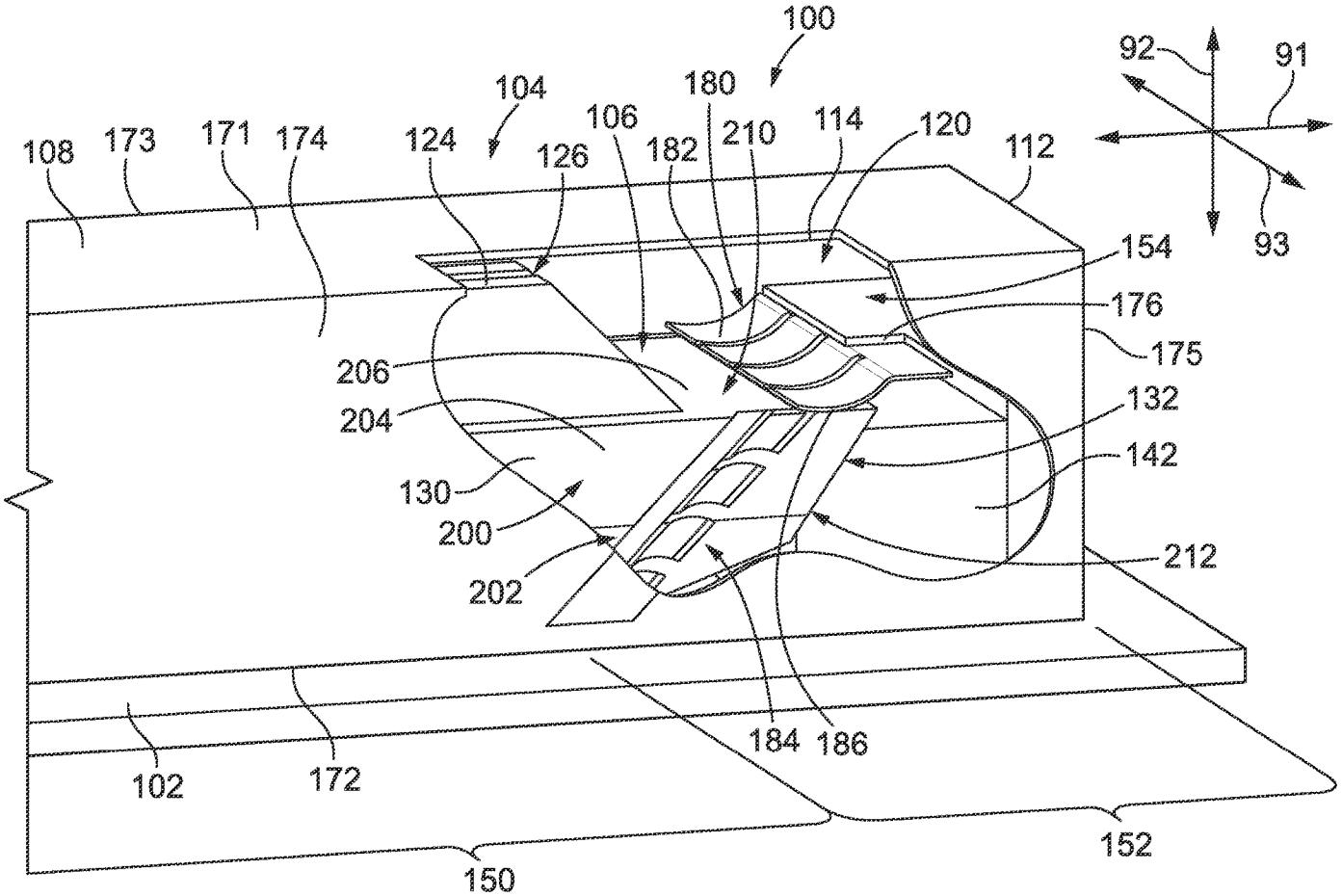
FIG. 2 is a perspective, partial sectional view of a portion of the communication system.

FIG. 1 is a front perspective view of a communication system 100 in accordance with an embodiment. FIG. 2 is a perspective, partial sectional view of a portion of the communication system 100. The communication system 100 may include a circuit board 102, a receptacle assembly 104 (FIG. 2) mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, while the receptacle assembly 104 is illustrated as a single port assembly configured to receive a single pluggable module 106, it is understood that other types of receptacle assemblies 104 may have multiple ports configured to receive multiple pluggable modules 106. For example, the receptacle assembly 104 may have stacked or ganged ports.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a cage member 108 that is mounted to the circuit board 102. The cage member 108 may be arranged at a bezel or faceplate 109 of a chassis of the system or device, such as through an opening in the faceplate 109. As such, the cage member 108 is interior of the device and corresponding faceplate 109 and the pluggable module(s) 106 is loaded into the cage member 108 from outside or exterior of the device and corresponding faceplate 109.

The cage member 108 includes a front end 110 (FIG. 1) and an opposite rear end 112. The front end 110 may be provided at, and extend through an opening in, the faceplate 109. The mating axis 91 may extend between the front and rear ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The cage member 108 is configured to contain or block electromagnetic interference (EMI) and guide the pluggable module(s) 106 during a mating operation. To this end, the cage member 108 includes a plurality of cage walls 114 that are interconnected with one another to form the cage member 108. The cage walls 114 may be formed from a conductive material, such as sheet metal and/or a polymer having conductive particles. In the illustrated embodiment, the cage walls 114 are stamped and formed from sheet metal. In some embodiments, the cage member 108 is configured to facilitate airflow through the cage member 108 to transfer heat (or thermal energy) away from the receptacle assembly 104 and pluggable module(s) 106. The air may flow from inside the cage member 108 (for example, behind the faceplate 109) to the external environment (for example, forward of the faceplate 109) or from outside the cage member 108 into the interior of the cage member 108. Fans or other air moving devices may be used to increase airflow through the cage member 108 and over the pluggable module(s) 106.

In the illustrated embodiment, the cage member 108 includes a single module cavity 120 (identified in FIG. 2); however the cage member 108 may include multiple module cavities in alternative embodiments, such as module cavities stacked vertically and/or stacked horizontally. The module cavity 120 extends between the front and rear ends 110, 112. The module cavity 120 has a port opening 122 that is sized and shaped to receive the pluggable module 106. The module cavity 120 extends lengthwise in a direction that is parallel to the mating axis 91.

In some embodiments, the pluggable module 106 is an input/output cable assembly having a pluggable body 130. The pluggable body 130 includes a mating end 132 (FIG. 2) and an opposite cable end 134 (FIG. 1). A cable 136 (FIG. 1) is coupled to the pluggable body 130 at the cable end 134. The pluggable body 130 also includes an internal circuit board 138 (shown in FIG. 4) that is communicatively coupled to electrical wires or optical fibers (not shown) of the cable 136. The cable 136 may be communicatively coupled by directly terminating the wires to the internal circuit board 138, such as by soldering the wires to the internal circuit board. Alternatively, the cable 136 may be communicatively coupled by other processes, such as by using connectors at the end of the cable 136 and on the internal circuit board 138. The internal circuit board 138 is supported by the pluggable body 130. The circuit board 138 includes contact pads 140 (shown in FIG. 4) at the mating end 132. In FIG. 1, the mating end 132 is configured to be inserted into the module cavity 120 of the cage member 108 and advanced in a mating direction along the mating axis 91.

In an exemplary embodiment, the pluggable body 130 provides heat transfer for the internal circuit board 138, such as for the electronic components on the internal circuit board 138. For example, the internal circuit board 138 is in thermal communication with the pluggable body 130 and the pluggable body 130 transfers heat from the internal circuit board 138. In an exemplary embodiment, the pluggable body 130 includes a plurality of heat transfer fins 124 along at least a portion of the outer perimeter of the pluggable module 106. For example, in the illustrated embodiment, the fins 124 are provided along the top; however the fins 124 may additionally or alternatively be provided along the sides and/or the bottom. The fins transfer heat away from the main shell of the pluggable body, and thus from the internal circuit board and associated components. The fins 124 are separated by gaps 126 that allow airflow or other cooling flow along the surfaces of the fins 124 to dissipate the heat therefrom. In the illustrated embodiment, the fins 124 are parallel plates that extend lengthwise, such as parallel to the mating axis 91; however the fins 124 may have other shapes in alternative embodiments, such as cylindrical or other shaped posts.

The fins 124 increase the overall height and/or width of the pluggable module 106 and the port opening 122 is sized to accommodate the fins 124 and allow the pluggable module 106, including the fins 124, to be loaded therethrough into the module cavity 120. In an exemplary embodiment, the module cavity 120 is at least partially open (for example, includes openings) at the front end 110 and the rear end 112, generally in line with the fins 124, to allow airflow through the module cavity 120 to enhance heat transfer. Such openings may be sized to control EMI emissions therethrough. Heat is transferred from at or near the mating end 132, such as where various electrical components are located on the internal circuit board 138, to the cable end 134 by the shell of the pluggable body 130 and the fins 124. The heat is pulled out of the receptacle assembly 104 by forward airflow through the module cavity 120 and rejected to the external environment forward of the faceplate 109. In other embodiments, the heat may be drawn into other portions of the pluggable body 130 and/or the heat may be directed to other portions of the pluggable body 130, such as toward the mating end 132, where the heat may be transferred to another heat sink or heat transferring component inside the chassis or be rejected by rearward airflow to the external environment through the rear end 112.

The receptacle assembly 104 includes a communication connector 142 having a mating interface 144 (shown in FIG. 4), and may have multiple mating interfaces when configured to mate with multiple pluggable modules 106, such as when used in a stacked cage member. The mating interface 144 is disposed within the module cavity 120. The mating interface 144 is generally aligned with the port opening 122 near the rear end 112. The mating interface 144 includes electrical contacts 146 (shown in FIG. 4) that are configured to directly engage the contact pads 140 of the pluggable module 106. The communication connector 142 is configured to be mounted to the circuit board 102. The communication connector 142 is configured to be loaded into the cage member 108 through the bottom. For example, the cage member 108 is configured to be mounted to the circuit board 102 over the communication connector 142 such that the communication connector 142 passes through an opening in the bottom as the cage member 108 is mounted to the circuit board 102.

The cage member 108 generally defines various portions or segments that receive different components and/or serve different functions. For example, in an exemplary embodiment, the module cavity 120 is divided into a pluggable module segment 150 and a communication connector segment 152 rearward of the pluggable module segment 150. The pluggable module segment 150 is at or near the front end 110 and receives the pluggable module 106. The communication connector segment 152 is at or near the rear end 112 and receives the communication connector 142. The pluggable module segment 150 may intersect with and/or overlap with the communication connector segment 152. The pluggable module 106 is mated with the communication connector 142 generally at the intersection between the segments 150, 152.

In an exemplary embodiment, the module cavity 120 includes an airflow channel 154 that allows airflow through the module cavity 120. For example, in the illustrated embodiment, the airflow channel 154 is an upper airflow channel 154 positioned along the top of the module cavity 120. The upper airflow channel 154 is located above the pluggable module 106 and allows airflow along the fins 124. In an exemplary embodiment, the airflow channel 154 is open at the front end 110 and at the rear end 112 to allow airflow through the module cavity 120 along the pluggable module 106. For example, the cage member 108 includes airflow openings 156 (shown in FIG. 3) in the cage wall 114 at the rear end 112 to allow airflow through such wall. The airflow openings 156 may be located above the communication connector 142. The airflow openings 156 may be located at other locations in alternative embodiments. The airflow openings 156 may be sized to limit or reduce EMI leakage through the cage wall 114 at the rear end 112.

Optionally, when the receptacle assembly 104 is a stacked receptacle assembly 104 having stacked module cavities 120, the cage walls 114 of the cage member 108 may include a separator plate between the module cavities 120. The separator plate may extend generally parallel to the mating axis 91 at least partially between the front end 110 and the rear end 112. The module cavities 120 and the separator plate may be stacked along the elevation axis 92. Optionally, a light-indicator assembly (not shown), such as a light pipe, may be provided in or along the separator plate. The separator plate may define one or more airflow channels in the module cavities 120, such as above or below the corresponding module cavities 120 to enhance heat transfer of the pluggable modules 106 located in the module cavities 120.

In some embodiments, the cage member 108 is formed from a plurality of interconnected panels or sheets, which define the cage walls 114. For example, the cage member 108 includes a top wall 171, a bottom wall 172, first and second side walls 173, 174 and a rear wall 175 at the rear end 112. The cage member 108 may include a front wall at the front end 110 or other walls. In an exemplary embodiment, the cage member 108 may include one or more interior panels defining an interior wall(s) 176. The interior panels may divide the cage member 108 into separate module cavities 120 (for example, an upper cavity and a lower cavity).

The panels or sheets may be stamped and formed from sheet metal. The bottom wall 172 is configured to rest on the circuit board 102. In an exemplary embodiment, the bottom wall 172 includes a communication connector opening 178 (shown in FIG. 3) therethrough that receives the communication connector 142 extending from the circuit board 102. The cage member 108 may be mounted onto the circuit board 102 over the communication connector 142 such that the communication connector 142 is loaded into the module cavity 120. When the cage member 108 is mounted to the circuit board 102, the cage member 108 is electrically coupled to the circuit board 102 and, in particular, to ground planes (not shown) within the circuit board 102 to electrically ground the cage member 108. As such, the receptacle assembly 104 may reduce EMI that may negatively affect electrical performance of the communication system 100.

In an exemplary embodiment, the receptacle assembly 104 includes an EMI skirt 180 in the module cavity 120. The EMI skirt 180 is interior of the cage walls 114 and faces the interior of the module cavity 120, such as the pluggable module 106 in the module cavity 120. The EMI skirt 180 may reduce EMI leakage from the cage member 108, from the communication connector 142 and/or from the pluggable module 106. Optionally, the EMI skirt 180 may include discrete members that surround different portions of the pluggable module 106 and module cavity 120. Alternatively, the EMI skirt 180 may be a continuous band or member that surrounds the pluggable module 106 and module cavity 120.

The EMI skirt 180 includes plural spring beams 182 configured to surround a mating perimeter 184 of the pluggable module 106 forward of a mating end 132 (for example, toward the cable end 134 from the mating end 132) of the pluggable module 106. Optionally, the mating perimeter 184 may be at or near the mating end 132, such as closer to the mating end 132 than the cable end 134. The spring beams 182 are deflectable and are elastically deformed against the mating perimeter 184 when the pluggable module 106 is mated with the communication connector 142. The spring beams 182 having mating interfaces 186 configured to engage and electrically connect to the pluggable module 106, such as to the pluggable body 130. Providing the EMI skirt 180 interior of the module cavity 120 at the mating end 132 moves the EMI component away from the front end 110 and the opening to the module cavity 120 at the front end 110, which leaves the module cavity 120 open to allow airflow therethrough for cooling the pluggable module 106. For example, conventional cage members provide EMI shielding at the front end 110 to close off the opening to the module cavity using EMI springs or shields that would otherwise block airflow into the module cavity.

The pluggable body 130 defines a shell around the internal circuit board 138. Optionally, the pluggable body 130 may be defined by first and second shells 200, 202 that are joined together above and below the internal circuit board 138. The first and second shells 200, 202 meet along sides 204 of the pluggable body 130. The first shell 200 defines an upper end or top 206 of the pluggable body 130 and the second shell 202 defines the lower end or bottom 208 of the pluggable body 130. In an exemplary embodiment, the EMI skirt 180 surrounds and engages the top 206, bottom 208 and opposite sides 204 of the pluggable module 106.

The sides 204, top 206 and bottom 208 generally extend between the mating end 132 and cable end 134 and define a cavity that holds the internal circuit board 138. Optionally, the internal circuit board 138 may be exposed at the mating end 132 for mating with the communication connector 142. Heat generated by the internal circuit board 138 is drawn into the upper shell 200 and/or the lower shell 202 and transferred therefrom. In an exemplary embodiment, the upper shell 200 includes the fins 124, which extend from the top 206; however the fins 124 may extend from the sides 204 and/or the bottom 208. The fins 124 increase the surface area of the upper shell 200 and allow greater heat transfer from the upper shell 200.

Optionally, the fins 124 may run substantially the entire length from the cable end 134 to the mating end 132. Optionally, the fins 124 may be recessed inward from the cable end 134 and/or the mating end 132. For example, platforms 210 may be defined at the mating end 132 and/or the cable end 134 along the pluggable body 130, such as along the top 206. The fins 124 extend to distal edges remote from the corresponding exterior surface of the pluggable body 130, such as the top 206.

Optionally, the pluggable body 130 may have a mating edge 212 at the mating end 132. The mating edge 212 is defined at the rear of the top 206, the bottom 208 and the sides 204. Optionally, the mating edge 212 along the sides 204 may be angled between the top 206 and the bottom 208 with the top 206 being offset rearward of the bottom 208. Other configurations are possible in alternative embodiments.

Figure 3:
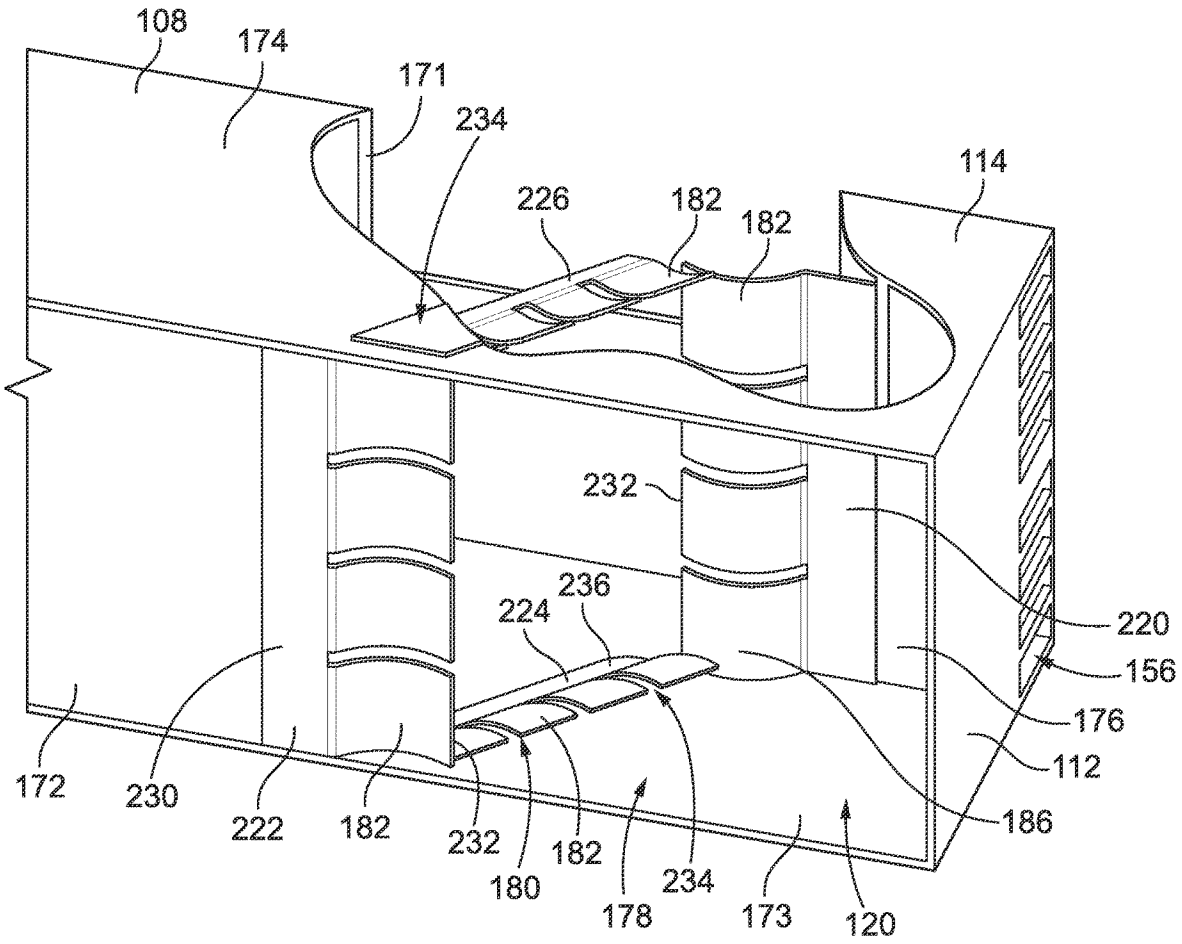
FIG. 3 is a bottom perspective, partial sectional view of a cage member and EMI skirt in accordance with an exemplary embodiment.

FIG. 3 is a bottom perspective, partial sectional view of the cage member 108 in accordance with an exemplary embodiment. FIG. 3 illustrates the communication connector opening 178 in the bottom wall 172 of the cage member 108. In the illustrated embodiment, the communication connector opening 178 is positioned immediately forward of the rear end 112. The EMI skirt 180 is generally aligned with the communication connector opening 178 interior of the module cavity 120.

In the illustrated embodiment, the EMI skirt 180 includes a plurality of skirt members each mounted to a different cage wall 114 of the cage member 108 to surround the module cavity 120. For example, the EMI skirt 180 includes a top skirt member 220, a bottom skirt member 222, a first side skirt member 224 and a second side skirt member 226 each being mounted to a different one of the cage walls 114. For example, the top skirt member 220 is mounted to an interior wall 176 near the top wall 171. The bottom skirt member 222 is mounted to the bottom wall 172. The first side skirt member 224 is mounted to the first side wall 173. The second side skirt member 226 is mounted to the second side wall 174. The spring beams 182 extend into the module cavity 120 and are positioned to interfere with the pluggable module 106 (shown in FIG. 2) when the pluggable module 106 is mated with the communication connector 142 (shown in FIG. 2). In an exemplary embodiment, at least some of the skirt members may be shifted or offset with respect to other skirt members. For example, the top skirt member 220 is offset rearward of the bottom skirt member 222. The first and second side skirt members 224, 226 are angled generally between the top and bottom skirt members 220, 222. Other arrangements are possible in alternative embodiments.

The EMI skirt 180 includes a base 230 mounted to the cage wall(s) 114. For example, in the illustrated embodiment, each of the skirt members 220, 222, 224, 226 includes a base 230 mounted to the corresponding walls 171, 172, 173, 174. However, in alternative embodiments having a single skirt member, the base 230 of the EMI skirt 180 is a band mounted to one or more of the cage walls 114. The base 230 may be mounted to the corresponding cage walls 114 by any known process. For example, the base 230 may be soldered to the cage wall 114. In alternative embodiments, the base 230 may be integral with the corresponding cage wall 114 rather than being separately provided and mounted thereto.

The base 230 may be generally planar having spring beams 182 extending from an edge thereof. In an exemplary embodiment, the base 230 and spring beams 182 are integrally formed. For example, the base 230 and spring beams 182 may be stamped and formed from a common blank or sheet of metal material. The spring beams 182 are curved or arc shaped between the base 230 and corresponding distal ends 232. The mating interfaces 186 are located along the curved spring beams 182, such as remote from the base 230 and remote from a distal ends 232. Optionally, the distal ends 232 may be tied together using tie bars rather than being free.

Optionally, the side walls 173, 174 may include pockets 234 formed therein. The bases 230 of the skirt members 224, 226 may be received in the corresponding pockets 234. The pockets 234 allow the bases 230 to be recessed into the cage member 108. For example, an interior 236 of each base 230 may be generally flush with the interior of the corresponding side walls 173, 174. Having the bases 230 recessed into the side walls 173, 174 provides clearance for the pluggable module 106 to be loaded into the module cavity 120. For example, the mating edge 212 (shown in FIG. 2) is allowed to pass the base 230 without the base 230 interfering with the mating edge 212 as the pluggable module 106 is loaded into the module cavity 120. As such, the pluggable module 106 may be loaded in close proximity to the side walls 173, 174 without hanging up on the bases 230 as the pluggable module 106 is loaded into the module cavity 120.

In an exemplary embodiment, the spring beams 182 of the top skirt member 220 (defining a first set of spring beams) are offset rearward of the spring beams 182 of the bottom skirt member 222 (defining a second set of spring beams). The spring beams 182 of the side skirt members 224, 226 may be stepped or staggered along the module cavity 120. In an exemplary embodiment, the spring beams 182 of the top skirt member 220 extend forward to the distal ends 232, while the spring beams 182 of the bottom skirt member 222 extend rearward to the distal ends 232. In the illustrated embodiment, the spring beams 182 of the side skirt members 224, 226 extend rearward to the distal ends 232. As such, the pluggable module 106 initially passes the bases 230 of the bottom skirt member 222 and side skirt members 224, 226 before interfacing with the spring beams 182, whereas the pluggable module 106 initially engages the spring beams 182 of the top skirt member 220. The distal ends 232 of the spring beams 182 of the top skirt member 220 are flared upward so as to not interfere with loading of the pluggable module 106 into the module cavity 120 during mating with the communication connector 142.

Figure 4:
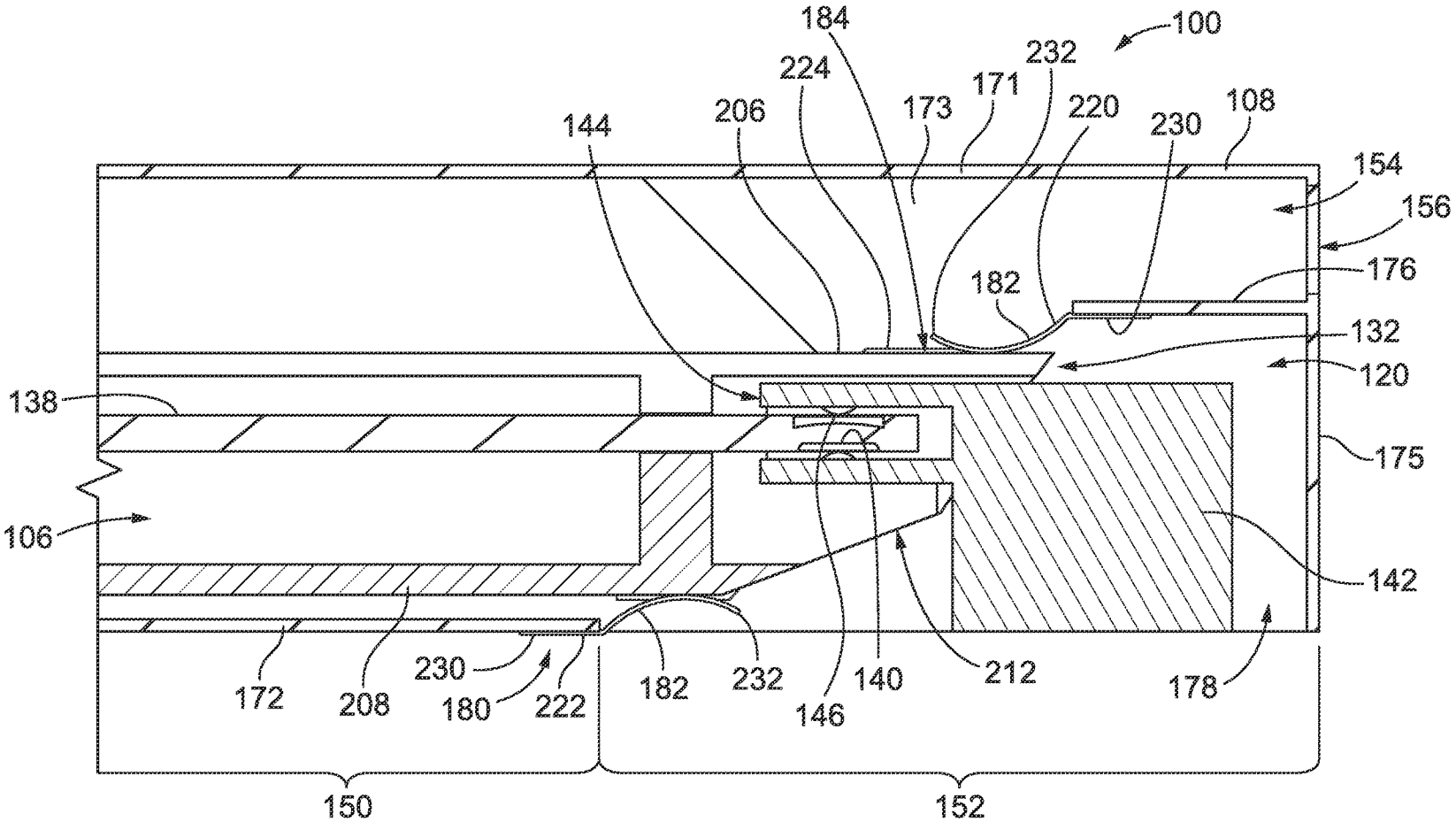
FIG. 4 is a cross-sectional view of a portion of the communication system showing a pluggable module loaded into the cage member and mated with a communication connector and EMI skirt.

FIG. 4 is a cross-sectional view of a portion of the communication system 100 showing the pluggable module 106 loaded into the cage member 108 and mated with the communication connector 142. The EMI skirt 180 engages the mating perimeter 184 of the pluggable module 106 to provide EMI shielding around the mating interface between the pluggable module 106 and the communication connector 142. When the pluggable module 106 is mated with the communication connector 142, the contact pads 140 of the internal circuit board 138 are mated with corresponding electrical contacts 146 of the communication connector 142.

The EMI skirt 180 is located generally at the intersection between the pluggable module segment 150 and the communication connector segment 152. The EMI skirt 180 is generally aligned with the communication connector opening 178. The EMI skirt 180 is located relative to the communication connector opening 178 such that the EMI skirt 180 does not interfere with loading of the communication connector 142 into the module cavity 120 as the cage member 108 is mounted to the circuit board 102 (FIG. 2). For example, the bottom skirt member 222 is offset forward, such as near the forward end of the communication connector opening 178 such that the distal end 232 of the spring beams 182 clear the forward or mating end of the communication connector 142.

In the illustrated embodiment, the base 230 of the bottom skirt member 222 is mounted to an exterior surface of the bottom wall 172. The spring beams 182 of the bottom skirt member 222 extend rearward therefrom into the module cavity 120 through the communication connector opening 178. Such spring beams 182 engage the bottom 208 of the pluggable module 106, such as immediately forward of the mating edge 212 of the pluggable module 106 at the mating end 132, which defines a portion of the mating perimeter 184.

The base 230 of the top skirt member 220 is mounted to a bottom surface of one of the interior panels or walls 176 of the cage member 108. The interior wall 176 is positioned a distance below the top wall 171 to define the airflow channel 154 along the top of the module cavity 120. The interior wall 176 holds the top skirt member 220 at a position that has little or no interference or effect on the airflow through the airflow channel 154. For example, the top skirt member 220 may be positioned below the airflow openings 156 in the rear wall 175. The spring beams 182 of the top skirt member 220 extend forward there from. Such spring beams 182 engage the top 206 of the pluggable module 106, such as immediately forward of the mating edge 212, which defines a portion of the mating perimeter 184.

The base 230 of the first side skirt member 224 (mostly hidden by the pluggable module 106) is mounted to an interior surface of the side wall 173 of the cage member 108. The spring beams 182 (not shown in FIG. 4) engage the corresponding side 204 (shown in FIG. 2) along the mating perimeter 184 defined along such side 204. Similarly, the second side skirt member 226 (shown in FIG. 2) engages the opposite side of the pluggable module 106. As such, the EMI skirt 180 surrounds the mating perimeter 184 of the pluggable module 106 forward of the mating end 132. The spring beams 182 are elastically deformed against the mating perimeter 184 when the pluggable module 106 is loaded into the cage member 108 and mated with the communication connector 142. As such, the spring beams 182 maintain electrical connection with the pluggable module 106.

While the mating edge 212 is shown to be slanted or angled and the skirt members 220, 222 are shown to be offset, in alternative embodiments, the mating edge 212 may be flat and/or the top and bottom skirt members 220, 222 may be vertically aligned with each other. Other configurations and arrangements of the skirt members are possible in alternative embodiments. The skirt members may be mounted to different areas or walls of the cage member 108. The airflow channel 154 may be located at a different location, which may cause the skirt members to be moved to other locations to not interfere with airflow through the module cavity 120.

Figure 5:
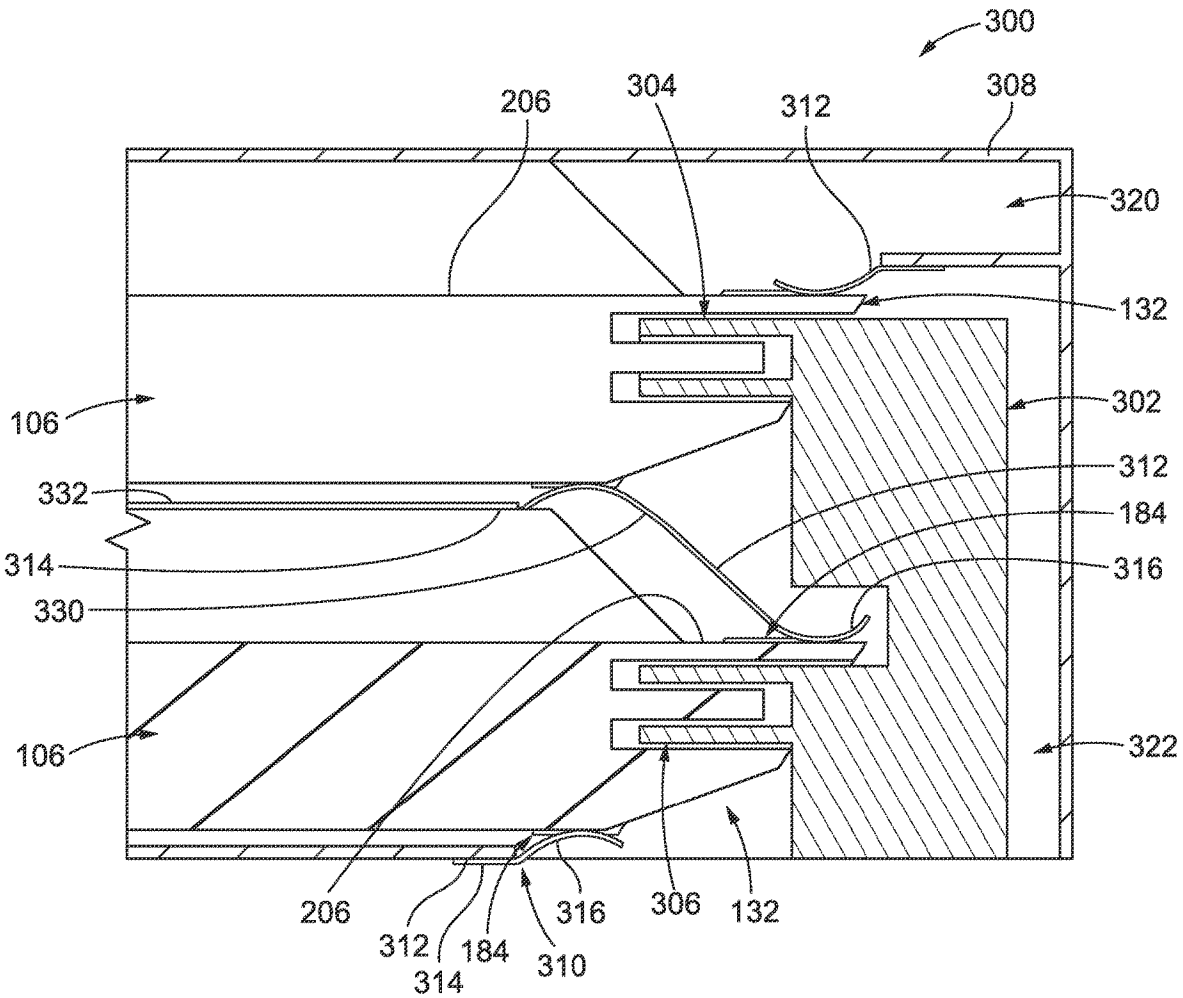
FIG. 5 is a cross-sectional view of a portion of a communication system formed in accordance with an exemplary embodiment, showing a stacked cage receiving a plurality of the pluggable modules.

FIG. 5 is a cross-sectional view of a portion of a communication system 300 formed in accordance with an exemplary embodiment, showing a stacked cage receiving a plurality of the pluggable modules 106. The communication system includes a stacked cage member 308 and a communication connector 302 having an upper mating interface 304 and a lower mating interface 306. The cage member 308 includes an EMI skirt 310 engaging the mating perimeters 184 of the pluggable modules 106 to provide EMI shielding around the mating interfaces between the pluggable modules 106 and the communication connector 302.

The EMI skirt 310 includes a plurality of skirt members 312, which may be similar to the skirt members 220, 222, 224, 226 (shown in FIG. 3). The skirt members 312 each include a base 314 and spring beams 316 extending from the base 314. The skirt members 312 are located within upper and lower module cavities 320, 322 of the cage member 308 to surround the mating ends 132 of the pluggable modules 106 and electrically engage the mating perimeters 184 of the pluggable modules 106.

Some of the spring beams 316 may be different lengths to extend between the corresponding mounting locations and the mating perimeters 184. For example, one of the skirt members 312 defines a middle skirt member 330. The middle skirt member 330 is mounted to a divider wall 332 of the cage member 308 separating the upper and lower module cavities 320, 322. The spring beams 316 of the middle skirt member 330 extend downward from the divider wall 332 to engage the top 206 of the lower pluggable module 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector assembly comprising:

a cage member having a plurality of walls defining a module cavity configured to receive a pluggable module therein through a front end of the cage member, the walls being manufactured from a metal material and providing electrical shielding for the module cavity, the walls extending rearward from the front end to a rear end of the cage member where the walls are configured to surround a communication connector at or near the rear end having a mating interface configured to be mated with the pluggable module, the module cavity having a pluggable module segment at or near the front end receiving the pluggable module and a communication connector segment at or near the rear end receiving the communication connector, the pluggable module segment meeting the communication connector segment at an intersection proximate to the mating interface of the communication connector; and an EMI skirt proximate to the intersection of the pluggable module segment and the communication connector segment of the module cavity such that the EMI skirt is positioned proximate to the mating interface of the communication connector with the pluggable module, the EMI skirt comprising plural spring beams configured to surround a mating perimeter of the pluggable module proximate to and forward of a mating end of the pluggable module configured to be mated with the communication connector, the spring beams being deflectable and being elastically deformed against the mating perimeter when the pluggable module is mated with the communication connector, the spring beams having mating interfaces configured to engage and electrically connect to the pluggable module, wherein the EMI skirt is positioned in the module cavity to engage at least two different sides of the pluggable module.

2. The connector assembly of claim 1, wherein the EMI skirt surrounds and engages a top, a bottom and opposite sidewalls of the pluggable module.

3. The connector assembly of claim 1, wherein the EMI skirt comprises at least one base mounted to a corresponding one of the walls, the spring beams extending from the corresponding base.

4. The connector assembly of claim 1, wherein the EMI skirt comprises a plurality of skirt members each mounted to a different one of the walls of the cage member to surround the module cavity.

5. The connector assembly of claim 1, wherein the EMI skirt is interior of the walls and faces an interior of the module cavity.

6. The connector assembly of claim 1, wherein the walls comprise a bottom wall having a communication connector opening at or near the rear end, the communication connector opening configured to receive the communication connector therethrough, the EMI skirt being aligned with the communication connector opening interior of the module cavity.

7. The connector assembly of claim 1, wherein the walls comprise side walls, the side walls having pockets open to the module cavity, the pockets receiving the EMI skirt.

8. The connector assembly of claim 7, wherein the EMI skirt comprises a base and the spring beams extend from the base, the base being received in the pockets such that an interior of the base is generally flush with the interior of the corresponding side wall.

9. The connector assembly of claim 1, wherein the spring beams comprise a first set of spring beams and a second set of spring beams, the first set of spring beams extending forward to distal ends, the second set of spring beams extending rearward to distal ends.

10. The connector assembly of claim 1, wherein the spring beams comprise a first set of spring beams and a second set of spring beams, the first set of spring beams being offset with respect to the second set of spring beams such that the first set of spring beams are positioned rearward of the second set of spring beams.

11. The connector assembly of claim 1, wherein the EMI skirt comprises a top skirt member, a bottom skirt member, a first side skirt member and a second side skirt member each being mounted to a different one of the walls of the cage member.

12. The connector assembly of claim 11, wherein the top skirt member is offset rearward of the bottom skirt member, the first and second side skirt members being angled generally between the top and bottom skirt members.

13. The connector assembly of claim 1, wherein the module cavity has an upper airflow channel inside of a top wall of the plurality of walls, the upper airflow channel being open at the front end and the rear end to allow airflow through the module cavity along the pluggable module, the EMI skirt being positioned below the upper airflow channel such that the airflow passes above the EMI skirt to or from the rear end.

14. The connector assembly of claim 1, wherein the cage member includes a divider wall dividing the module cavity into an upper module cavity and a lower module cavity each configured to receive a pluggable module, the EMI skirt extending from the divider wall to directly engage the pluggable module in the upper module cavity and the pluggable module in the lower module cavity from the divider wall.

15. A communication system comprising:

a pluggable module comprising a pluggable body extending between a mating end and a cable end, the pluggable body having a top and an opposite bottom with sides extending therebetween along a length of the pluggable body, the pluggable body having a mating perimeter defined by the top, the bottom and the sides along a portion of the length forward of the mating end, the pluggable module having an internal circuit board held in the pluggable body; and a connector assembly comprising a communication connector and a cage member, the cage member having a plurality of walls defining a module cavity, the walls being manufactured from a metal material and providing electrical shielding for the module cavity, the module cavity having a pluggable module segment at or near a front end of the cage member receiving the pluggable module, the module cavity having a communication connector segment at or near a rear end of the cage member receiving the communication connector, the communication connector having a mating interface configured to be mated with the pluggable module, the pluggable module segment meeting the communication connector segment at an intersection proximate to the mating interface of the communication connector, the connector assembly having an EMI skirt proximate to the intersection of the pluggable module segment and the communication connector segment of the module cavity such that the EMI skirt is positioned proximate to the mating interface of the communication connector with the pluggable module, the EMI skirt comprising plural spring beams surrounding the mating perimeter of the pluggable module, the spring beams being deflectable and being elastically deformed against the mating perimeter when the pluggable module is mated with the communication connector such that the internal circuit board is communicatively coupled to the communication connector, the spring beams have mating interfaces configured to engage and electrically connect to the corresponding top, bottom and sides of the pluggable module at the mating perimeter; wherein the EMI skirt comprises a plurality of skirt members each mounted to a different one of the walls of the cage member to engage different portions of the pluggable module.

16. The communication system of claim 15, wherein the pluggable body includes a plurality of fins extending outward from at least one of the top, the bottom and the sides, the fins being positioned at the front end such that the fins allow airflow between the module cavity and an exterior environment forward of the cage member.

17. The communication system of claim 15, wherein the EMI skirt comprises at least one base mounted to a corresponding one of the walls, the spring beams extending from the corresponding base.

18. The communication system of claim 15, wherein the plurality of skirt members are each mounted to the different one of the walls of the cage member to entirely surround the pluggable module.

19. The communication system of claim 15, wherein the walls comprise a bottom wall having a communication connector opening at or near the rear end, the communication connector opening configured to receive the communication connector therethrough, the EMI skirt being aligned with the communication connector opening interior of the module cavity.

20. The communication system of claim 15, wherein the module cavity has an upper airflow channel inside of a top wall of the plurality of walls, the upper airflow channel being open at the front end and the rear end to allow airflow through the module cavity along the pluggable module, the EMI skirt being positioned below the upper airflow channel such that the airflow passes above the EMI skirt to or from the rear end.

* * * * *